United States Patent [19]

Walters

[11] 4,362,084

[45] Dec. 7, 1982

[54] HYDRAULIC ACTUATOR CONTROLS

[75] Inventor: Ronald B. Walters, Wembley, England

[73] Assignee: Sperry Corporation, Troy, Mich.

[21] Appl. No.: 159,362

[22] Filed: Jun. 13, 1980

[30] Foreign Application Priority Data

Jun. 15, 1979 [GB] United Kingdom ..... 7920932

[51] Int. Cl.[3] ..... F15B 13/16

[52] U.S. Cl. ..... 91/47; 91/433; 137/625.64; 137/625.63; 137/567

[58] Field of Search ..... 91/433, 47, 51, 6; 137/567, 625.64, 625.63; 417/287, 7

[56] References Cited

U.S. PATENT DOCUMENTS 3,732,887 5/1973 Haynes ..... 91/433 UX 3,763,746 10/1973 Walters ..... 91/433

3,872,887 3/1975 Wohbrab ..... 137/567

3,922,954 12/1975 Gustafsson ..... 137/115 X

*Primary Examiner*—Alan Cohan

*Attorney, Agent, or Firm*—Barnes, Kisselle, Raisch & Choate

[57] ABSTRACT

The flow of fluid to a hydraulic load (18) is controlled by controlling a bleed-off path (31, 32) by means of a main valve (20) responsively to the difference between a first input force produced by a force motor (52) and a second (hydraulic feedback) force produced by a flow sensor (74) in the passage (33) leading to the load (18). The pressure difference across the flow sensor is applied by lines (75, 76 and 71, 70) to opposed feedback chambers (56, 55) to act on the pilot spool (40) upon which the force motor (52) acts.

12 Claims, 6 Drawing Figures

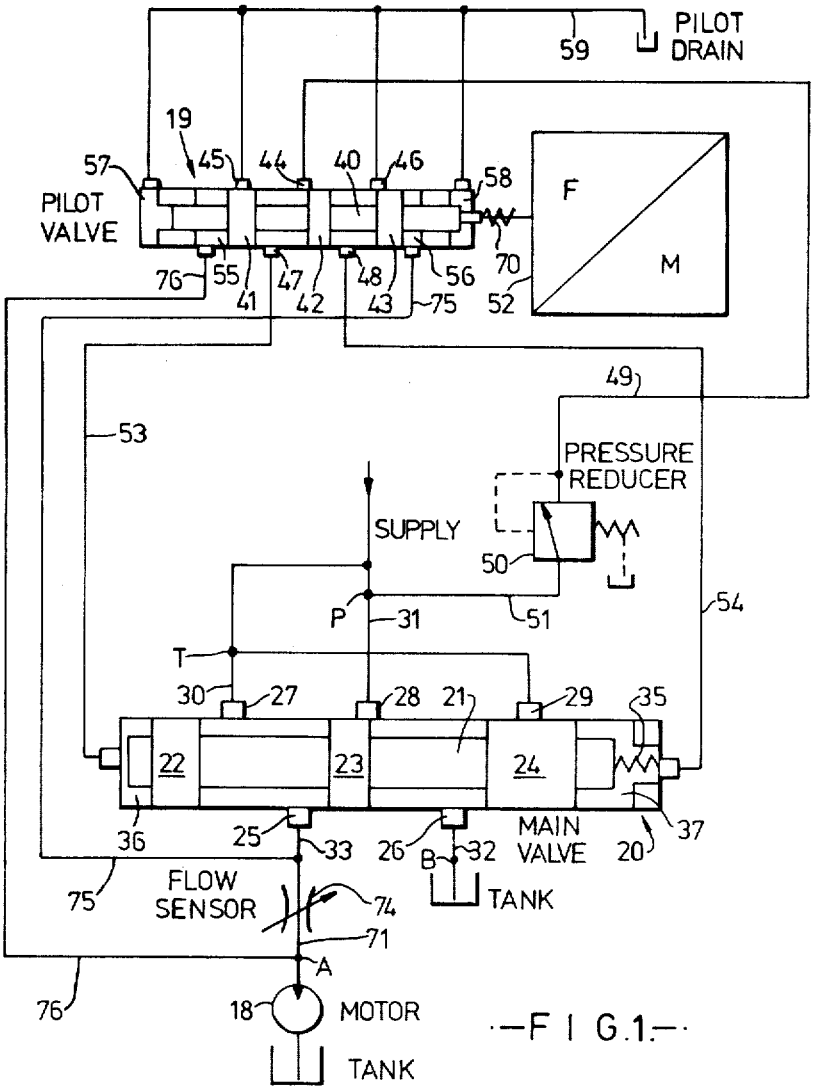
—FIG.1—

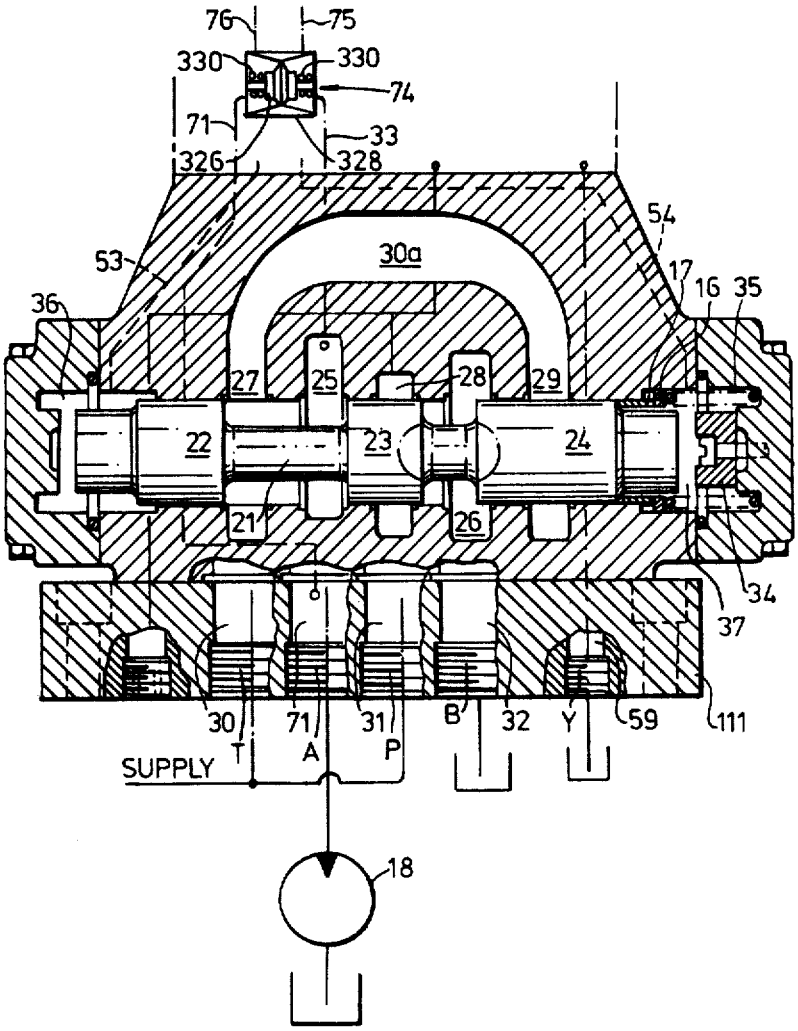
-FIG.2.-

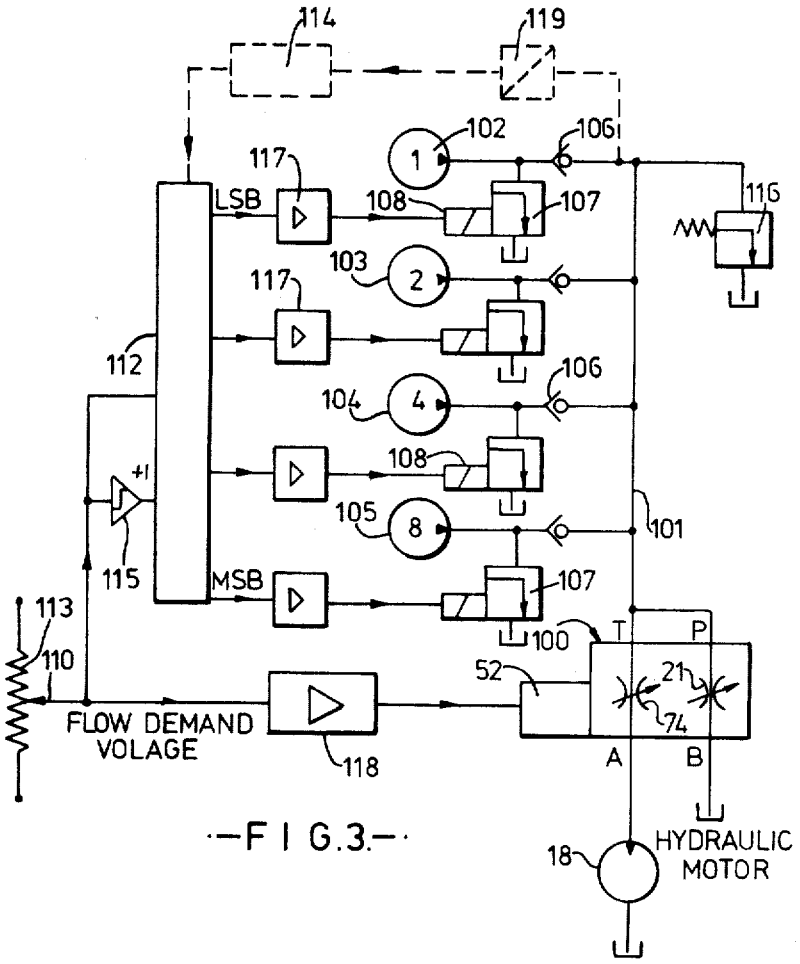
-FIG.3.-

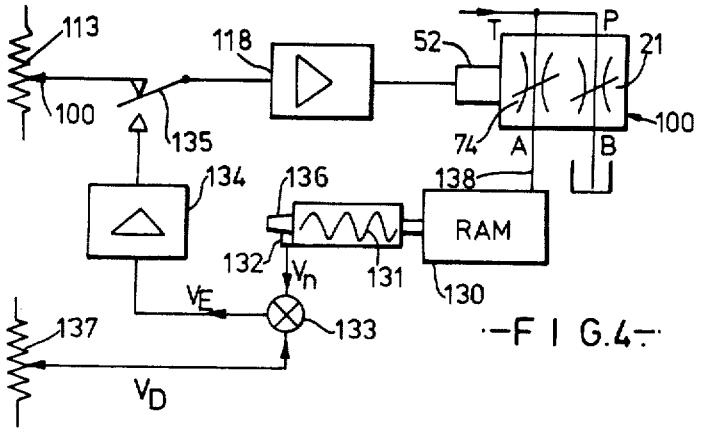
-FIG.4-
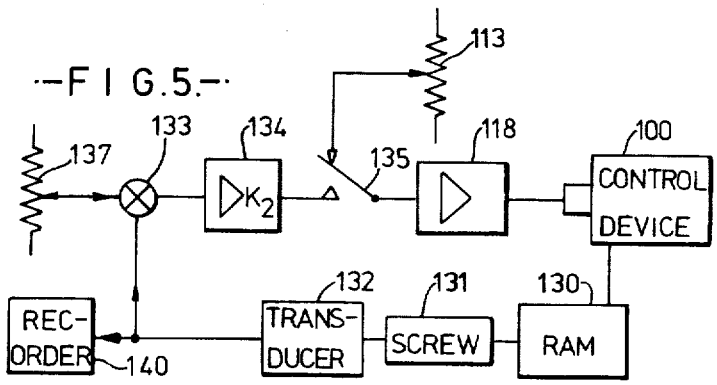
-FIG.5-
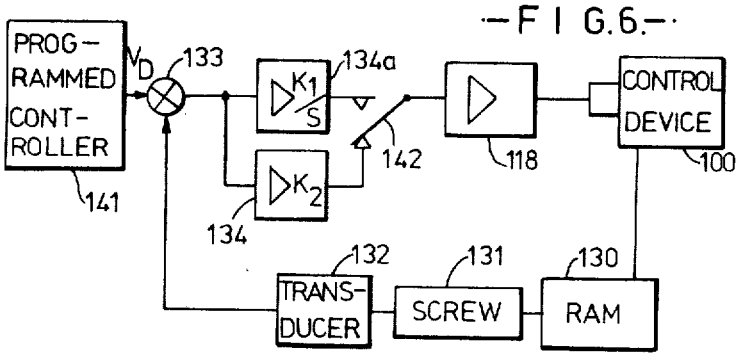
-FIG.6-

HYDRAULIC ACTUATOR CONTROLS

DESCRIPTION

The present invention relates to hydraulic actuator controls and more particularly to a device for controlling the flow of fluid from a pressure input to a hydraulic load responsive to an electrical input signal.

When operating a hydraulic load from a fixed positive displacement pump and when controlling the rate of flow of fluid to the load by throttling the fluid in a control valve, the excess delivery of the pump not required by the load flows away to drain via a pressure relief valve. This relief valve operates at full pump pressure and represents a substantial power loss at part loads as does the throttling of the flow to the load itself.

It is known to reduce the power loss when operating a load from a fixed positive displacement pump by connecting the load directly to the pump and by controllably by-passing part of the pump delivery through a bleed-off so that the desired quantity of fluid flows to the load. Since the fluid flows to the load unrestricted in this case, the pump delivery pressure is no more than that required to operate the load and so the pressure drop across the bleed-off control valve is no longer necessarily the maximum pump outlet pressure but only the actual pressure operating the load at any given time. In order words, the control valve in the bleed-off path replaces the conventional pressure relief valve, although an emergency relief valve may nevertheless be provided or an existing relief valve may be used merely as a safety valve.

It is also known to measure the amount of fluid flowing to the load by means of an electro-hydraulic flow sensor and to compare the electrical signal from the flow sensor with an electrical input signal, the difference between these two electrical signals being used to adjust the control valve in the bleed-off path. Whilst such a system provides for automatic control of the rate of flow of the fluid to the load in accordance with the input signal it does have a number of drawbacks, particularly from the safety angle. One particular disadvantage is that, in the event of an electrical fault in the feedback circuit, there will be an absence of a feedback signal as a result of which the control valve will close off the bleed-off path and operate the load at maximum power.

It is an object of the present invention to provide a hydraulic load control device which controls the flow rate to a load by controlling flow through a bleed-off path wherein the system operates with a fail-safe feature in the event of an electrical fault.

According to the present invention a device for controlling the flow of fluid from a pressure input to a hydraulic load responsively to an electrical input signal, comprises a flow sensor serially connected to the pressure input for conducting fluid to the load; a fluid pressure-operated main valve having a main spool for regulating fluid flow from the pressure input and through a bleed-off path by-passing the flow sensor and the load and thereby inversely regulating the fluid flow to the load; a pilot valve for controlling the main valve, said pilot valve including a pilot spool for regulating the fluid pressure for operating the main valve; an electrical force motor for producing a first force dependent upon said electrical input signal and for applying said first force to said pilot spool, an opposed piston arrangement operative upon said pilot spool; and hydraulic feedback means for applying the pressure difference produced across the flow sensor to the opposed piston arrangement in a direction to apply to said pilot spool a second force opposed to said first force.

In the event of an electrical failure, the force motor simply does not operate so that the hydraulic feedback from the flow sensor regulates the pilot valve to a position in which it opens the main valve and thereby fully opens the bleed-off path.

The flow sensor used in the device of the present invention may be that described and illustrated in British Pat. No. 1,335,042. Various uses of such a flow sensor are described and illustrated in British Pat. No. 1,406,326. The latter British patent shows the same basic valve structure used in three different flow configurations, firstly with the flow sensor in the return flow to tank, secondly with the flow sensor in the supply from the pressure source and thirdly in one of the service lines to the load, but in each case the main valve controls the fluid flowing to and from the load. It is a very advantageous feature of the present invention that the device shown in British Pat. No. 1,406,326 can be modified in a very simple way without any significant structural changes so as to operate in a flow configuration as a device in accordance with the present invention. All that is necessary is for the spool of the main valve to be modified so that the valve port leading to or from the flow sensor remains in permanent communication with an opposing port.

Thus, according to a preferred feature of the present invention, the main valve is a modification to a four port, three position valve in that the main spool, which provides a controlled flow path (the bleed-off path) from a first port connected to the pressure input to a second port connected to drain, is modified to provide a permanent uncontrolled flow path from a third port, which is connected to the first port, to a fourth port connected to the load, the flow sensor being in said permanent flow path, and in that means are provided to prevent the main spool from being displaced to its third position beyond a null position in which the bleed path is closed.

It is another advantageous feature of the present invention for the main spool to be spring biassed to its operated position in which the bleed path is at its maximum opening. This ensures that in the absence of a hydraulic signal from the pilot valve, the main valve will fully open the bleed-off path to fully by-pass the load.

Because the device of the present invention only controls the flow of fluid to a hydraulic load, it cannot be used for reversing the direction of flow through the load and if the load is reversible a separate change-over valve is needed. However, because the device of the present invention operates uni-directionally, the force motor itself can be made uni-directional which is particularly advantageous because a uni-directional proportional solenoid can be used as the force motor and is substantially less expensive than a bi-directional force motor.

The invention is further described by way of example with reference to the drawings in which:

FIG. 1 is a flow diagram of a fluid flow control device in accordance with the present invention.

FIG. 2 is a sectional view of the main valve of the control device,

FIG. 3 is a flow diagram of one particular application of the control device of the present invention, FIG. 4 is a flow diagram of another application of the control device of the invention, and FIGS. 5 and 6 are similar flow diagrams to illustrate a method of operating an injection moulding machine.

The device of FIGS. 1 and 2 comprises a main valve 20 and a pilot valve 19 for controlling the main valve 20. The main and pilot valves are arranged in separate valve blocks which are bolted together with the respective fluid ports in connection with one another to provide the desired fluid communications as described hereinafter.

The main valve 20 has a main spool 21 provided with lands 22, 23 and 24 of which the lands 23 and 24 control connection between an inlet port 28 and an outlet port 26, the ports 25 and 27 being in permanent interconnection as hereinafter described and the port 29 which is connected to the port 27 remaining closed off by the land 24. A supply passage 31 from a pressure input P is connected to the central port 28 and a return passage 32 leads from the port 26 to a port B used in the present configuration as a tank port. A supply of pressure fluid is connected both to the port P and to the port T, which is connected by a passage 30 to the port 27. The port 25 is connected by a passage 33 to a flow sensor 74 which leads via a passage 71 to a port A, the port A being connected to the hydraulic load in the form of a motor 18 whose outlet is itself connected to tank.

The spool 21 is biassed away from a null position in which the port 28 is connected to the port 26 to the left in the drawings by a spring 35 which is disposed in a right-hand control chamber 37. There is no spring in the left-hand control chamber 36 at the other end of the spool 21. The main spool 21 is displaced away from its left-hand position towards its null position by the application of a pressure difference between the chambers 36 and 37 by means of the pilot valve 19.

The pilot valve 19 has a pilot spool 40 which is provided with three lands, 41, 42 and 43 controlling fluid connection between a central inlet port 44 and drain ports 45 and 46 on the one hand and control ports 47 and 48 on the other hand. The inlet port 44 is connected by a line 49 to the outlet of a pressure reducing valve 50 which serves to maintain a constant pressure in the line 49. The inlet to the pressure reducing valve 50 is connected to a supply line 51 which can, if desired, be connected to the same source as the port P. The pilot spool 40 can be displaced from its neutral position by means of a uni-directional linear force motor 52 which is adapted to produce a force directly proportional to the electrical current applied thereto. The force motor 52 incorporates a return spring 70 which biasses the pilot spool 44 to the left and the force produced by the force motor acts to the right. The control ports 47 and 48 are connected by respective control lines 53 and 54 to the control chambers 36 and 37 of the main valve 20.

The pilot valve 19 has annular feedback chambers 55 and 56 at the sides of the lands 41 and 43 facing the respective ends of the pilot spool 40. The chambers 57 and 58 at the extreme ends of the spool 40 are connected to a drain line 59 as are the drain ports 45 and 46. Feedback pressures are applied from the upstream side of the flow sensor 74 via line 75 to the feedback chamber 56 and from the downstream side of the flow sensor via line 76 to the feedback chamber 55.

The flow sensor 74 is disposed between the passages 33 and 71 between the port 25 and the port A. The flow sensor comprises a housing 328 (FIG. 2) which is connected by fluid connections at its opposite ends to the passages 33 and 71. A movable member 326 in the housing divides the housing into two chambers connecting respectively with the ports 25 and A. Co-operating surfaces in the housing and on the movable member define a fluid path interconnecting said chambers. The flow cross-section of the fluid path is variable dependently upon the position of the movable member which is itself biassed by a spring (shown as two springs 330) to a position in which the fluid path is substantially obturated. Said co-operating surfaces are so designed that the pressure drop between the two chambers of the flow sensor is proportional to the rate of fluid flow through the flow sensor. The two chambers of the flow sensor are also connected to the feedback lines 75 and 76.

The flow sensor is preferably constructed in the same manner as the flow sensor described in British Pat. No. 1,335,042. However, as the fluid always flows through the flow sensor in one direction only it is sufficient for the flow sensor to be displaceable in one direction only from its obturating position in which it substantially closes the fluid path. Thus, the movable member may co-operate with a valve seat when in its obturating position and a bleed path may be provided between the two chambers of the flow sensor to make the flow sensor more sensitive to low flow rates as described in our British Patent Application No. A 2,022,847.

The main stage is shown in more detail in FIG. 2 and is in fact identical to the main stage of the device illustrated in British Pat. No. 1,406,326, except that the spool 21 has been modified in that the lands 22 and 23 have been shortened, a return spring 35 is provided in the right-hand control chamber 37 only and a stop 34 is fitted to prevent the spool 21 being displaced to the right beyond it null position. So that the spring 35 can act on the spool 31 when the latter is in its left-hand position, the spring 35 acts via an abutment ring 16 and a tube 17 on the right-hand end of the land 24. It can be seen that the lands 22 and 23 have been shortened axially so that the port 27 remains in permanent connection with the port 25 throughout the permitted travel of the main spool 21. The port 27 is in permanent connection with the port T through the passage 30 in the housing and the port 25 is in permanent condition with the flow sensor through the passage 33. This enables the port T of the existing valve structure to be used as the inlet port to the flow sensor 74 whose outlet port is in permanent connection with the port A to which the motor 18 is connected. Although the port 29 is in permanent connection with the port 27 via a passage 30*a* provided in the valve block, the port 29 remains closed by the land 24 because the stop 34 prevents the main spool 21 from being displaced to the right beyond its null. position. Although the flow sensor 74 is shown in FIG. 2 diagrammatically as being in a block separate from the main valve block it could be incorporated within the main valve block as indicated diagrammatically in the drawings of British Pat. No. 1,406,326. The ports T, A, P and B are formed in a port plate 111 attached to the main valve block and also containing a port Y to which the pilot drain line 59 is connected.

Referring again to FIG. 1, it is supposed that the force motor 52 has been energised to displace the pilot spool 40 to the right as illustrated. This connects the control chamber 36 of the main valve 20 to the pilot supply and connects the control chamber 37 to drain.

The main spool is thereby also displaced to the right as illustrated, away from its extreme left-hand position to which it is biassed by the spring 35. In its extreme left-hand position the port 28 is connected directly to tank via the bleed-off path provided by the passages 31 and 32 so that the pump operates at a very low pressure, insufficient to operate the motor even though the supply is permanently connected to the motor via the ports 27 and 25 and the flow sensor 74. The movement of the main spool 21 to the right restricts the flow between the ports 28 and 26 thereby throttling the fluid flowing through the bleed-off path so that the pump can develop pressure and supply fluid to the motor 18. The resulting fluid flow through the flow sensor 74 produces a pressure difference between the lines 75 and 76 and thereby between the feedback chambers 56 and 55. The pressure difference between the chambers 56 and 55 produces a net second force acting on the pilot spool 40 to the left, i.e. in a direction to oppose the electrically dependent first force produced by the force motor 52, thereby tending to return the pilot spool to its null position. In the steady state the pilot spool is returned to its null position with the main spool 21 suitably displaced to produce a bleed-off flow and thereby a load speed at which the pressure drop across the flow sensor 74 balances the force applied by the force motor 52. The speed of the motor 18 is therefore in the steady state solely dependent upon the electrical signal supplied to the force motor 52.

Should there be an electrical fault in the device of FIGS. 1 and 2, the force motor 52 would likely become inoperative and the hydraulic feedback from the flow sensor 74 would shift the pilot spool 40 to its left-hand position in which pressure is applied to the control chamber 37 of the main valve 20 and the control chamber 36 is connected to drain. The main valve is thereby immediately fully operated to by-pass the motor 18. This fail-safe feature is further enhanced by the single return spring 35 which also biasses the main spool 21, to its left-hand position in which the motor 18 is by-passed. Furthermore, the bias spring 70 returns the pilot spool 40 to its left-hand end position in the absence of an electrical signal to the force motor 52 and this applies pilot pressure to the right-hand control chamber 37 to urge the main spool to its fully open left-hand end position.

FIG. 3 of the drawings illustrates a hydraulic system in which the present invention is useful. The control device is indicated at 100, the main spool 21, the force motor 52 and the flow sensor 74 being represented diagrammatically. This drawing clearly shows how the ports T and P are both connected to a main supply line 101, the port A is connected to a hydraulic motor 18 and the port B is connected to tank. The main supply line 101 is fed by four fixed displacement pumps 102, 103, 104 and 105, all differing in capacity. The capacities of the pumps increase progressively on a binary scale in that the pump 103 has twice the capacity of the pump 102, the pump 104 has twice the capacity of 103 and the pump 105 has twice the capacity of the pump 104. Thus the pumps 102,103, 104 and 105 can be regarded as being respectively one, two, four and eight units of capacity. Each pump delivers to the main supply line 101 through a respective non-return valve 106 and is provided with a respective electrically controlled by-pass valve 107. When the solenoid 108 of a by-pass valve 107 is not energised, the outlet of the respective pump is connected directly to drain. When a solenoid is energised, the by-pass valve 107 is closed so that the respective pump can deliver through the respective non-return valve 106.

An electrical input signal in the form of a flow demand voltage is obtained at an adjustable tapping 110 of a potentiometer 113. The electrical signal is supplied on the one hand via a drive amplifier 118 to the force motor 52 and on the other hand to a four-bit analog-to-digital converter 112. The converter 112 has four outputs connected via respective drive amplifiers 117 to the solenoids 108 of the by-pass valves 107.

The converter 112 is programmed to ensure that the appropriate ones of the pumps 102 to 105 are placed in service to meet the flow demand of the hydraulic motor 18 as set by the tapping 110.

An extra unit signal is applied to the converter 112 by means of a saturation amplifier 115. This achieves a full unit output as soon as the potentiometer 113 leaves the zero position. This ensures that the pumping capacity will exceed the demanded flow output by one unit to allow for 0 to 1 unit of variable bleed-off flow.

A safety relief valve 116 is connected to the main supply line 101.

Since pump leakage increases with an increase in pressure a correction factor may be applied by a pressure transducer 119 to a converter compensation circuit 114 to set the converter 112 to a higher unit of capacity when predicted pump leakage would demand an increased pump capacity in service.

FIG. 4 shows a modification to the control device of the present invention to enable it to be used in a pressure control mode as well as the flow control mode described above. In FIG. 4, the hydraulic load comprises a ram 130 for axially actuating the feed screw 131 of an injection moulding machine. Whilst the screw is being advanced, its linear velocity is controlled by the control device 100 to a predetermined value, as set on the potentiometer tapping 110. Once the stroke has been substantially completed, the ram 130 is operated to apply a predetermined "packing pressure" to the plastics material in the injection moulding nozzle 136. Hitherto, a separate control valve has been provided to control the ram 130 during the packing phase. To enable the same control device 100 to be used to control the ram 130 in this packing phase and thereby to obviate the need for a separate control valve, a feedback pressure $P_n$ is obtained from a pressure transducer 132 and is converted into an electrical feedback signal $V_n$ which is compared in a comparator 133 with a voltage $V_D$ tapped from a potentiometer 137 and representing a desired packing pressure. The resulting error signal $V_E$ is passed via a pre-amplifier 134 to a changeover switch 135 by means of which the drive amplifier 118 is disconnected from the flow demand potentiometer 113 and instead connected to the output of the pre-amplifier 134, thus closing the pressure control loop. Whilst the pressure transducer 132 could be connected to the port A in order to measure the hydraulic pressure applied to the ram 130, a more accurate measurement of the actual parameter to be controlled is obtained by placing the pressure transducer 132 in the injection nozzle 136, as shown, so that the pressure $P_n$ represents the nozzle pressure.

During the injection phase, the changeover switch 135 is in its illustrated position in which the velocity of the ram 130 is controlled according to the setting of the potentiometer 113, as described above with reference to FIGS. 1 and 2 and the pressure feedback loop is broken. When the stroke of the ram 130 is almost completed, the switch 135 is changed over so that the pressure in the injection nozzle is adjusted to a value predetermined by the setting of the potentiometer 137 and found by experiment or trial and error to give the optimum quality moulded product.

A separate hydraulic motor (not shown) is provided for rotating the screw 131 but the screw is not rotated during the injection and packing phases. When the injection operation has been completed a changeover valve (not shown) in the line 138 between the control device 100 and the ram 130 is actuated to connect the ram to drain and the motor is operated to rotate the screw 131. Rotation of the screw retracts the ram 130 ready for the next injection moulding operation which can be commenced as soon as the screw has stopped turning.

FIG. 5 illustrates the same injection moulding machine as FIG. 4 but rather more diagrammatically. Like parts are denoted by like reference numerals but a recorder 140 is connected to the output of the pressure transducer 132 in order to record the nozzle pressure $P_n$ against time over an injection cycle and in particular during the injection phase. After the potentiometers 113 and 137 have been adjusted by experiment to obtain the maximum quality injection-moulded product, the recorded pressure/time or pressure/stroke characteristic relating to that product is used to programme a controller 141 illustrated in FIG. 6.

FIG. 6 corresponds to FIG. 5 but the potentiometers 113 and 137 have been taken out of circuit and the programmed controller 141 and a buffer amplifier 134*a* have been placed in circuit. Thus, the controller 141 is connected to the comparator 133 to feed thereto the signal $V_D$ corresponding to the desired nozzle pressure $P_D$ at any given time during the injection stroke, the desired nozzle pressure $P_D$ being in accordance with the experimentally determined programme.

The buffer amplifier 134*a* can be brought into operation during the injection phase instead of the pre-amplifier 134 (which is only used during the packing phase) by means of a changeover switch 142. The gain $K_1$ of the buffer amplifier 134*a* is generally different from the gain $K_2$ of the pre-amplifier 134 but the buffer amplifier has an integrating behaviour S. The integrating behaviour S is needed to ensure that a signal is provided to keep the pilot valve of the control device 100 open and so keep the ram moving, even when there is no error signal $V_E$.

When the ram 130 approaches the end of its injection stroke, the controller 141 brings the higher gain pre-amplifier 134 into use in place of the buffer amplifier 134*a* so that the nozzle pressure $P_n$ is controlled during the packing phase as described previously.

If desired, the controller 141 can be used during the injection phase only and the potentiometer 137 can be switched into circuit during the packing phase. A further possibility is for the potentiometer 137 to be incorporated in the controller 141.

Instead of two separate amplifiers 134 and 134*a* as shown, it may be preferable to use a single variable gain amplifier controlled by the controller 141 in accordance with the progress of each injection stroke.

Generally, the recorder 140 will record the nozzle pressure against ram travel during the injection phase and the nozzle pressure against time during the packing phase, the ram travel being small or even imperceptible during the packing phase.

I claim:

1. A device for controlling the flow of fluid from at least one pump to a hydraulic load responsively to an electrical input signal, said one pump being a positive displacement pump and having a pressure outlet, said device comprising a flow sensor serially connected to the pressure input for conducting fluid to the load, the series circuit consisting of the flow sensor and the load being directly connected to said pump pressure outlet, said flow sensor being adapted to generate a pressure difference dependent upon the rate of fluid flow therethrough; means defining a bleed-off path connected directly to said pump pressure outlet and by-passing said series circuit consisting of said flow sensor and said load, said means including a fluid pressure-operated main valve having a main spool for regulating fluid flow from the pump pressure outlet and through said bleed-off path and thereby inversely regulating the fluid flow to said load; a pilot valve for controlling said main valve, said pilot valve including a pilot spool for regulating the fluid pressure for operating said main valve; an electrical force motor for producing a first force dependent upon said electrical input signal and for applying said first force to said pilot spool; an opposed piston arrangement operative upon said pilot spool; and hydraulic feedback means for applying said pressure difference produced across said flow sensor to said opposed piston arrangement in a direction to apply to said pilot spool a second force opposed to said first force.

2. A device for controlling the flow of fluid from a pressure input to a hydraulic load responsively to an electrical input signal, comprising a flow sensor serially connected to the pressure input for conducting fluid to the load, said flow sensor being adapted to generate a pressure difference dependent upon the rate of fluid flow therethrough; means defining a bleed-off path by-passing said flow sensor and said load, said means including a fluid pressure-operated main valve, said main valve being a modification to a four-port, three-position valve and having a first port connected to said pressure input, a second port connected to drain, a third port connected to said first port and a fourth port connected to said load, said main valve also having a main spool for regulating fluid flow from the pressure input and through said bleed-off path and thereby inversely regulating the fluid flow to said load, said main spool being shiftable from a first position which is a null position in one direction to a second position to provide a controlled flow path from said first port to said second port and shiftable in the unmodified four-port, three-position valve from said first position in a direction opposite to said one direction to a third position in which said first port would be connected to said fourth port, said controlled flow path being closed when said main spool is in said null position and being in said bleed-off path, said modification to said four-port, three-position valve consisting in that said main spool is modified to provide a permanent uncontrolled flow path from said third port to said fourth port connected to the load, said flow sensor being in said permanent flow path, and in that means are provided to prevent said main spool from being displaced beyond said null position to said third position; a pilot valve for shifting said main valve spool, said pilot valve including a pilot spool for regulating the fluid pressure for operating said main valve; an electrical force motor for producing a first force dependent upon said electrical input signal and for applying said first force to said pilot spool; an opposed piston arrangement operative upon said pilot spool; and hydraulic feedback means for applying said pressure difference produced across said flow sensor to said opposed piston arrangement in a direction to apply to said pilot spool a second force opposed to said first force.

3. A device according to claim 2 in which said flow sensor is downstream of said main valve.

4. A device according to claim 1, in which said main spool is spring-biassed to its operated position in which said bleed path is at its maximum opening.

5. A device according to claim 1, in which said force motor is unidirectional.

6. A device according to claim 1, in which said first force produced by said force motor is directly proportional to the electrical signal applied thereto.

7. A device according to claim 1, in which said flow sensor comprises a housing having at opposite ends thereof fluid connections by which said flow sensor is connected in said flow path from said pressure input to said load, a movable member in said housing and dividing said housing into two chambers communicating respectively with said fluid connections, said housing and said movable member having co-operating surfaces thereon to define a fluid path interconnecting said chambers and having a restricted flow cross section, said flow cross section being variable dependently upon the position of said movable member in said housing, and spring means biassing said movable member to a position in which said flow cross section is at a minimum, said movable member being movable against said spring means responsively to fluid pressure difference between said chambers in a direction to increase said flow cross section.

8. A device according to claim 7, in which said co-operating surfaces are so shaped that the pressure difference between said chambers is substantially directly proportional to the rate of fluid flow through said variable cross section and the first force produced by the force motor is directly proportional to the electrical current supplied to the force motor.

9. A device according to claim 1 in combination with at least one positive displacement pump, said pressure input being connected to said positive displacement pump.

10. A device according to claim 1 in combination with a plurality of pumps of differing capacities, said pressure input being connected to said pumps, said pumps being adapted to be individually controlled in response to said electrical input signal to place in service at any given time appropriate ones of the pumps to meet but not greatly exceed the demand of said load.

11. A device according to claim 10, in which said pumps are of capacities which progressively increase on a binary scale.

12. A device according to claim 10, in which said pumps are all connected through individual non-return valves to said pressure input and are provided with unloader valves, an analog-to-digital converter to whose input said electrical signal is fed being provided to control said unloader valves individually, the pumps being selectively taken out of service by the opening of the respective unloader valves.

* * * * *